US006032722A

United States Patent [19]

Russell et al.

[11] Patent Number: 6,032,722

[45] Date of Patent: Mar. 7, 2000

[54] STRIP CASTING

[75] Inventors: Wayne Russell, Wollongong, Australia; Heiji Kato, Yokosuka, Japan

[73] Assignees: Ishikawajima-Harima Heavy Industries Company Limited, Tokyo, Japan; BHP Steel (JLA) Pty Ltd., New South Wales, Australia

[21] Appl. No.: 09/292,882

[22] Filed: Apr. 16, 1999

[30] Foreign Application Priority Data

May 4, 1998 [AU] Australia ..... PP3315

[51] Int. Cl.[7] ..... B22D 11/06

[52] U.S. Cl. ..... 164/428; 164/480

[58] Field of Search ..... 164/428, 480

[56] References Cited

U.S. PATENT DOCUMENTS 5,588,479 12/1996 Leadbeatter et al. ..... 164/428

5,810,070 9/1998 Osada et al. ..... 164/480

*Primary Examiner*—Kuang Y. Lin

*Attorney, Agent, or Firm*—Kerham, Stowell, Kondracki & Clarke, P.C.; John C. Kerins

[57] ABSTRACT

Twin roll caster for casting metal strip comprises pair of horizontal casting rolls (1) on which to support a casting pool of molten metal. A pair of side plates (18) engage end surfaces of rolls (1) to form side confining closures for the casting pool. A pair of side plate holders (25) hold plates (18) and thrusters (21) apply opposing inward closure forces to side plates (18). Thrusters (21) are connected to side plate holders (25) by pivot connections defined by horizontal pivot pins (26) and vertical pivot pins (28) which permit side plates (18) to self-align with the roll ends by rocking movements both longitudinally and laterally of the rolls but to constrain the plates against rotation in the general planes of the plates.

10 Claims, 3 Drawing Sheets

STRIP CASTING

TECHNICAL FIELD

This invention relates to continuous casting of metal strip in a twin roll caster. It has particular, but not exclusive, application to the casting of steel strip.

In a twin roll caster molten metal is introduced between a pair of contra-rotated horizontal casting rolls which are cooled so that metal shells solidify on the moving roll surfaces and are brought together at the nip between them to produce a solidified strip product delivered downwardly from the nip between the rolls. The term "nip" is used herein to refer to the general region at which the rolls are closest together. The molten metal may be poured from a ladle into a smaller vessel or series of vessels from which it flows through a metal delivery nozzle located above the nip so as to direct it into the nip between the rolls, so forming a casting pool of molten metal supported on the casting surfaces of the rolls immediately above the nip and extending along the length of the nip. This casting pool is confined between side plates or dams held in sliding engagement with end surfaces of the rolls so as to dam the two ends of the casting pool against outflow.

It is very important to maintain good sealing engagement between the side plates and the end surfaces of the rolls since leakage can lead to the formation of severe defects at the edges of the cast strip product and the solidifying leaked metal can cause rapid destruction of the wear surfaces of the side plates and complete loss of sealing. This problem is exacerbated by deformation of the roll ends due to thermal expansion during casting. Parts of the roll passing through the pool during each rotation are heated progressively as they move from the upper regions of the pool to the nip. Consequently there is a tendency for the mid-parts of the roll in the region of the nip to expand outwardly more than the upper parts of the roll which deforms the roll end surface during casting. This can lead to excessive wear of the side plates adjacent the nip.

Australian Patent Application 34397/95 and corresponding U.S. Pat. No. 5,588,479 discloses a twin roll caster in which the side plates are held in a pair of structures which are pivotally connected to horizontally acting thrusters by pivot connections which allow tilting movements of the closure structures so as to enable the end plates to self-align with the ends of the rolls to accommodate end misalignments of the rolls either due to initial misalignment or deformation of the roll ends due to thermal expansion during casting. It is further disclosed that each pivot connection should preferably be disposed below the centre of effort of the outward forces applied to the respective side plate closure structure by the molten metal of the pool so as to cause the side closure structure to be rotationally biased by the outward pressure applied by the molten metal of the pool in such a direction that its lower part is biased inwardly of the rolls.

The construction disclosed in Australian Application 34397/95 and U.S. Pat. No. 5,588,479 has performed reasonably well in the casting of thin steel strip. However it has been found that the provision of a simple universally pivoting joint can lead to operational difficulties in some circumstances. Specifically, the simple pivot joint allows the plate not only to rock longitudinally and laterally of the rolls to provide the required self-alignment of the plates, but the plates are also free to rotate in their own general planes ie. they can each rotate about a horizontal axis extending longitudinally of the casting pool. It has been found that such rotational movements of the plates can cause them to expose different contact face areas to the ends of the rolls and if the plates are already worn they can have wear shoulders which upset the contact with the newly exposed faces resulting in poor contact, misalignment of the side dams and leakage of molten metal from the casting pool. The present invention provides an improved arrangement in which the self-aligning rocking movements of the plates are permitted but the plates are constrained against the unwanted bodily rotation.

DISCLOSURE OF THE INVENTION

According to the invention there is provided a twin roll strip caster for casting metal strip comprising a pair of generally horizontal casting rolls forming a nip between them;

metal delivery means to deliver molten metal into the nip between the casting rolls to form a casting pool of molten metal supported on the rolls;

a pair of side plates to engage end surfaces of the rolls whereby to form side confining closures for the casting pool; and means to rotate the casting rolls in mutually opposite directions whereby to produce a cast strip delivered downwardly from the nip;

wherein the apparatus comprises side closure applicator means comprising a pair of side plate holders to hold the side plates, a pair of generally horizontally acting thrusters connected one to each of the side plate holders by pivot connections allowing tilting movements of the side plates, the thrusters are disposed to apply opposing inward closure forces to the side plates, and the pivot connections between the thrusters and the side plate holders are such as to permit the side plates to self-align with the roll ends by rocking movements both longitudinally and laterally of the rolls but to constrain the plates against rotation in the general planes of the plates.

The thrusters may comprise a pair of pressure fluid piston and cylinder units.

The thrusters may further comprise a pair of thruster bodies acted on by the piston and cylinder units and pivotally connected to the plate holders by said pivot connections.

Preferably, each pivot connection defines a vertical pivot axis and a horizontal pivot axis which is perpendicular to the vertical pivot axis and extends transversely of the roll ends and is such that movement of the respective plate holder relative to the thruster body is confined to pivoting movements about said vertical and horizontal pivot axes.

BRIEF DESCRIPTION OF THE DRAWINGS

In order that the invention may be more fully explained one particular embodiment will be described in detail with reference to the accompanying drawings in which.

DETAILED DESCRIPTION OF THE PREFERRED EMBODIMENT

Figure 1:
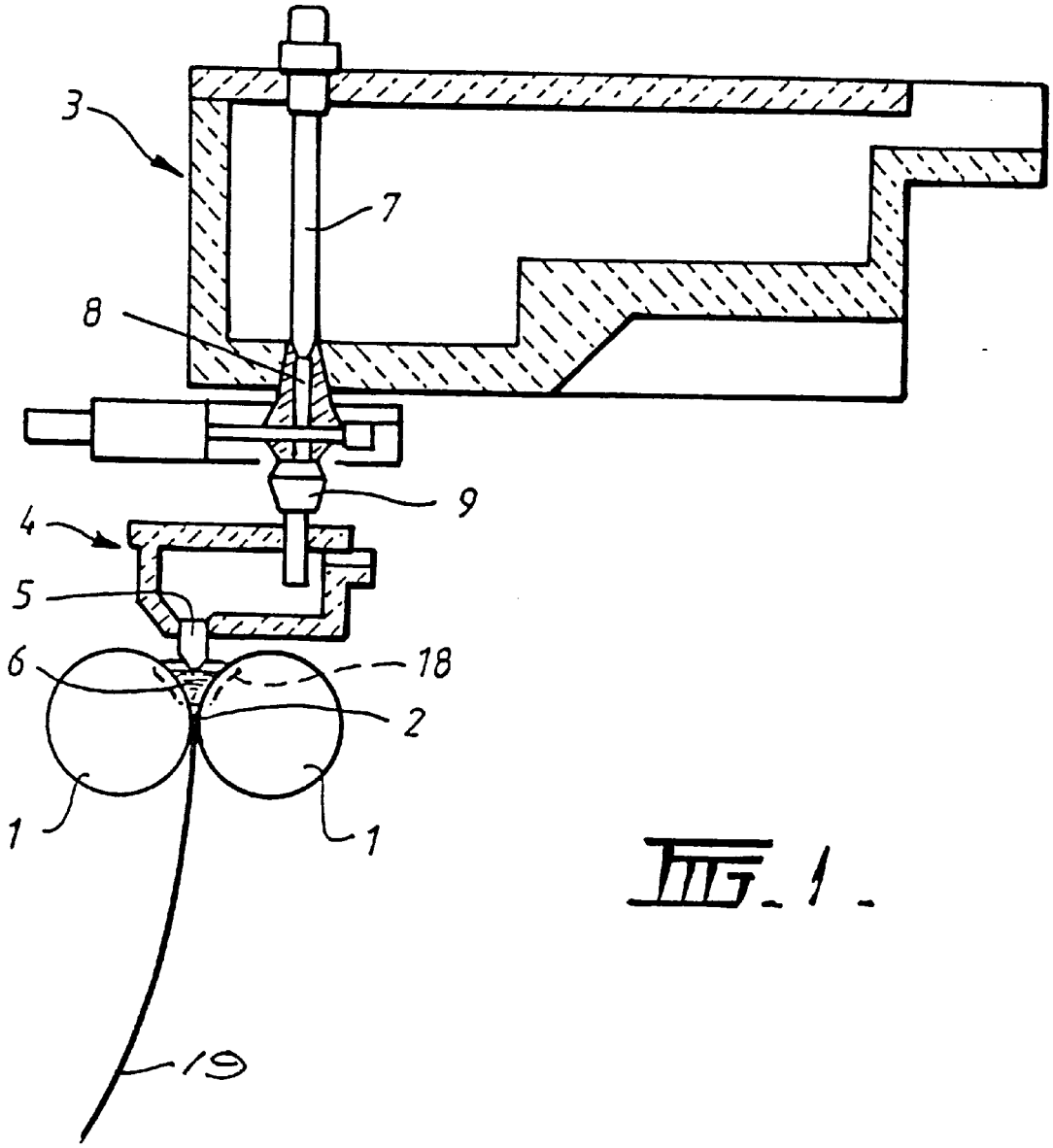
FIG. 1 is a vertical cross-section through a twin roll caster.
Figure 2:
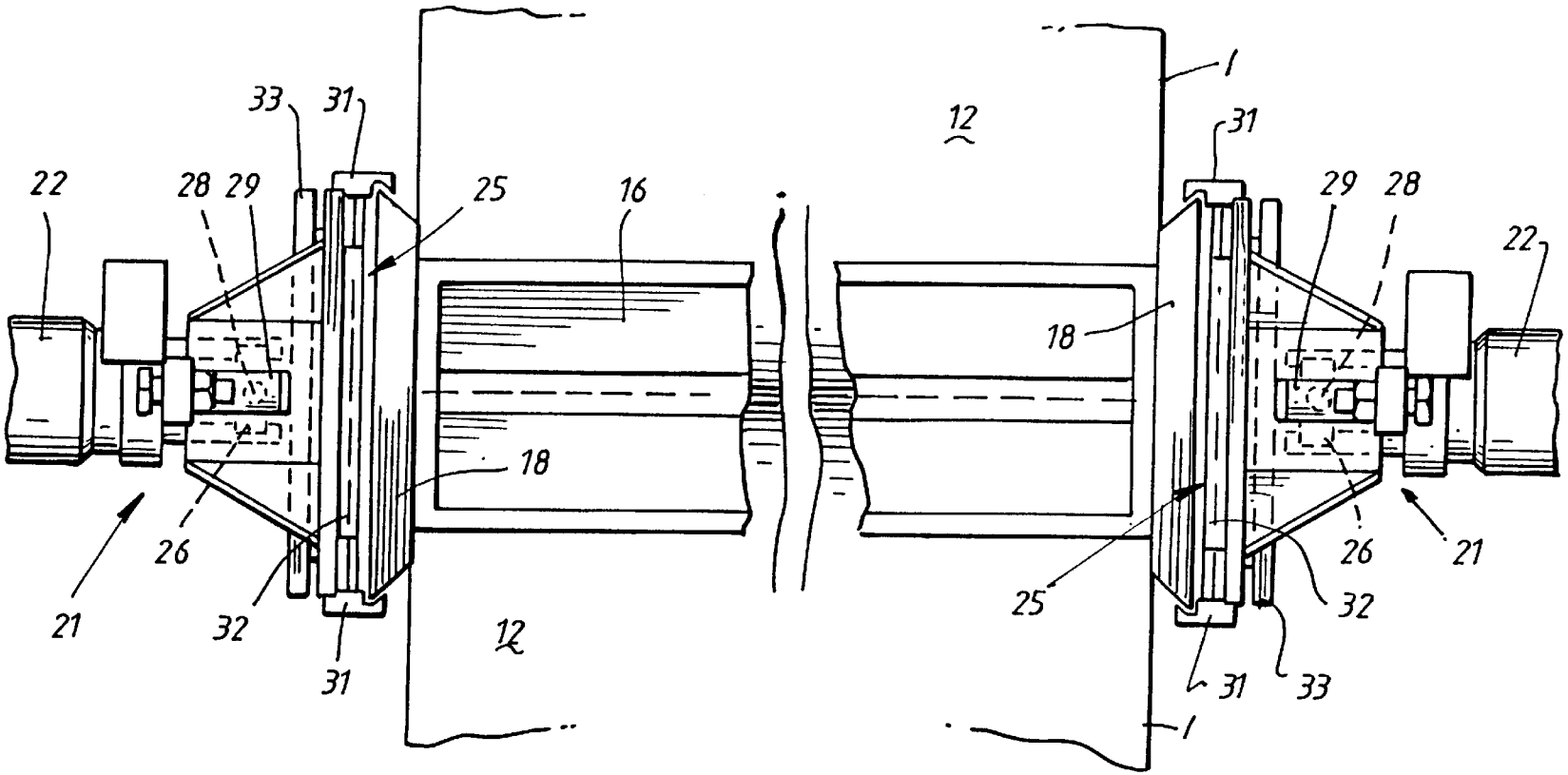
FIG. 2 is a plan view of the twin roll caster illustrated in FIG. 1.

The illustrated strip caster comprises a pair of twin casting rolls 1 forming a nip 2 between them. Molten metal is supplied during a casting operation from a ladle (not shown) via a tundish 3, distributor 4 and a delivery nozzle 5 into the nip between the rolls 1 so as to produce a casting pool 6 of molten metal supported on the casting surfaces 12 of the rolls above the nip. The ends of the casting pool are confined by a pair of refractory side closure plates 18 which are applied to stepped ends of the rolls by a pair of thrusters 21 comprising hydraulic cylinder units 22. Tundish 3 is fitted with a stopper rod 7 actuable to allow the molten metal to flow from the tundish through an outlet nozzle 8 and a refractory shroud 9 into distributor 4.

Casting rolls 1 are water cooled so that shells solidify on the moving roller surfaces and are brought together at the nip 2 between them to produce a solidified strip product 19 at the roll outlet. This product may be fed to a standard coiler (not shown).

The illustrated twin roll caster as thus far described is of the kind which is illustrated and described in some detail in granted Australian Patent 664670 and U.S. Pat. No. 5,488,988 and reference may be made to those patents for appropriate constructional details which form no part of the present invention.

Side plates 18 are mounted in holders 25 which are pivotally connected to the thrusters 21 so that the side plates can tilt about the pivot connections and the thrusters apply opposing forces through the pivots. In accordance with the present invention the pivot connections are provided in such a way that each side plate can rock longitudinally of the rolls by pivoting movement about a horizontal pivot axis transverse to the rolls and can rock laterally of the rolls by pivoting movement about a vertical pivot axis perpendicular to the horizontal pivot axis, the pivoting movement of the plates being confined to movements about those two specific axes so that planar rotation of the plates is prevented.

Figure 3:
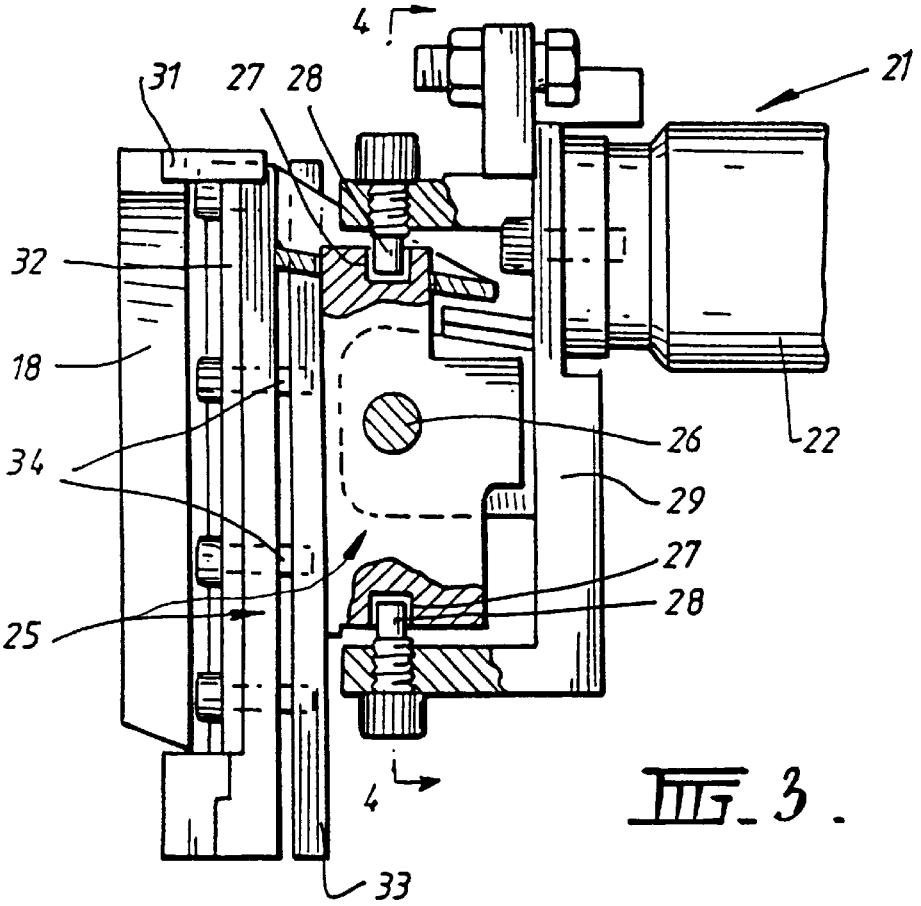
FIG. 3 illustrates one of a pair of side plate applicators incorporated in the apparatus.
Figure 4:
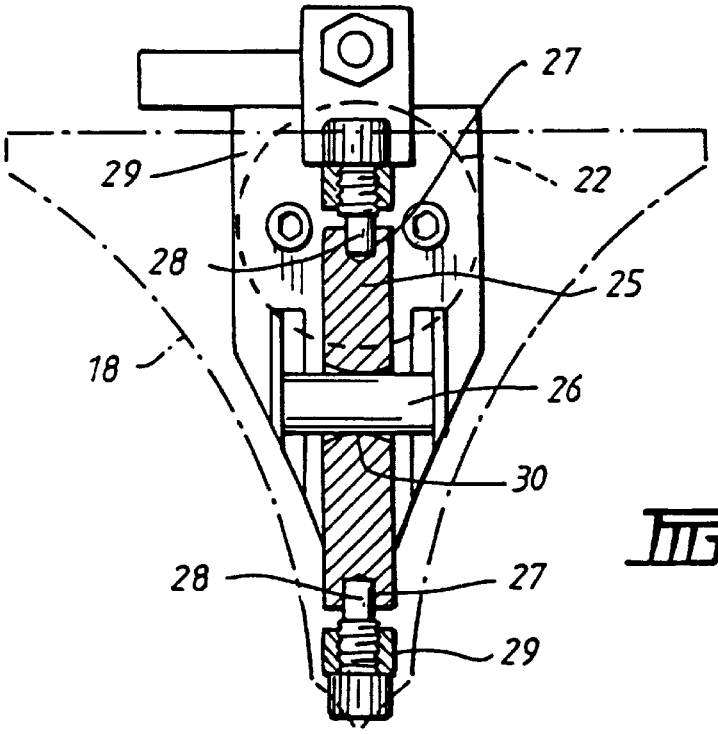
FIG. 4 is a cross-section on the line 4–4 in FIG. 3.

As most clearly seen in FIGS. 3 and 4, each side plate 18 is mounted in a side plate holder 25 which is pivotally connected by a horizontal pivot pin 26 and a pair of vertical pivot pins 28 to a thruster body 29 at the end of the respective thruster 21. The vertical pivot pins 28 are fixed to thruster body 29 and fit into elongate slots 27 in the plate holder. Slots 27 are elongate in the direction longitudinal to the thruster 21 to leave small clearance gaps about the pivot pins 28 which permit limited rocking movement of the plate holder 25 about horizontal pin 26 longitudinally of the rolls.

Horizontal pivot pin 26 is also mounted on the thruster body 29 and engages an internally convex bearing 30 in the plate holder so that the plate holder 25 can rock laterally of the casting rolls about the vertical axis defined by the pivot pins 28. The degree to which the plate holder is free to rock in this manner may be limited by engagement with stops on the thruster body 29.

Side plate holders 25 comprise side members 31 provided with inwardly facing channels to receive the side plates 18 and connected by stainless steel backing plates 32 connected to holder bodies 33 by studs 34 so as to leave an air gap between the backing plates and the holder body. The air gap provides thermal insulation of the main body part of the plate holder and the outer parts which actually engage the side plates can readily be replaced when they become damaged or distorted through use.

The horizontal pivot pins 26 are located at such a height above the level of the nip between the casting rolls that the effect of the outward pressure on the side plates due to the molten metal in the casting pool is such as to rotationally bias the side plates about the pivots in such directions that their bottom ends are biased inwardly so as to produce increased sealing pressure at the bottom of the casting pool. The arrangement permits tilting of the side plates so as to accommodate deformation of the casting roll end surfaces due to thermal expansion during casting and at the same time maintains a biasing action which increases the sealing forces at the bottom of the pool so as to counter-act the increased ferrostatic pressure at the bottom of the pool where there is accordingly the greatest tendency for leakage.

Appropriate positioning of the pivots will depend on the diameter of the casting rolls, the height of the casting pool and thickness of the strip being cast. The manner in which correct positioning of the pivots can be determined is fully described in our Australian Patent Application 34397/95 and U.S. Pat. No. 5,588,479.

We claim:

1. A twin roll strip caster for casting metal strip comprising a pair of generally horizontal casting rolls forming a nip between them;

metal delivery means to deliver molten metal inot the nip between the casting rolls to form a casting pool of molten metal supported on the rolls;

a pair of side plates to engage end surfaces of the rolls whereby to form side confining closures for the casting pool, each of said pair of side plates having a generally planar configuration defining a general plane of each plate; and means to rotate the casting rolls in mutually opposite directions whereby to produce a cast strip delivered downwardly from the nip;

wherein the apparatus comprises side closure applicator means comprising a pair of side plate holders to hold the side plates, a pair of generally horizontally acting thrusters connected one to each of the side plate holders by pivot connections allowing tilting movements of the side plates, the thrusters are disposed to apply opposing inward closure forces to the side plates, and the pivot connections between the thrusters and the side plate holders are such as to permit the side plates to self-align with the roll ends by rocking movements both longitudinally and laterally of the rolls but to constrain the plates against rotation in the general planes of the plates.

2. A twin roll strip caster as claimed in claim 1, wherein the thrusters comprise a pair of pressure fluid piston and cylinder units.

3. A twin roll caster as claimed in claim 2, wherein the thrusters are a pair of hydraulic piston and cylinder units.

4. A twin roll caster as claimed in claim 2, wherein the thrusters further comprise a pair of thruster bodies acted on by the piston and cylinder units and pivotally connected to the plate holders by said pivot connections.

5. A twin roll caster as claimed in claim 4, wherein each pivot connection defines a vertical pivot axis and a horizontal pivot axis which is perpendicular to the vertical pivot axis and extends transversely of the roll ends and is such that movement of the respective plate holder relative to the thruster body is confined to pivoting movements about said vertical and horizontal pivot axes.

6. A twin roll caster as claimed in claim 5, wherein each plate holder is pivotally connected to a respective thruster body by a horizontal pivot pin defining said horizontal pivot axis and by a pair of vertical pivot pins defining said vertical pivot axis.

7. A twin roll caster as claimed in claim 6, wherein the vertical pivot pins are fixed to the respective thruster body and fit into elongate slots in the plate holder which slots extend longitudinally of the thruster to define clearance gaps about the vertical pivot pins permitting limited rocking movement of the plate holder about the horizontal pivot pin longitudinally of the rolls.

8. A twin roll caster as claimed in claim 6, wherein the said horizontal pivot pin is mounted on the thruster body and engages a convex bearing in the plate holder so that the plate holder can rock laterally of the casting rolls about the vertical pivot axis defined by the vertical pivot pins.

9. A twin roll caster as claimed in claim 6, wherein the horizontal pivot pins are located at such a height above the level of the nip between the casting rolls that the effect of the outward pressure on the side plates due to the molten metal in the casting pool is such as to rotationally bias the side plates about the pivots in such directions that their bottom ends are biased inwardly to produce increased sealing pressure at the bottom of the casting pool.

10. A twin roll caster as claimed in claim 1, wherein the side plate holders comprise side members provided with inwardly facing channels to receive the side plates said side plate holders further comprising backing plates at an inner part of said channels and holder bodies disposed at sides of said backing plates opposite sides on which said side plates are held, wherein said backing plates are connected to said holder bodies by studs so as to leave an air gap between said backing plates and said holder bodies.

* * * * *